US007524160B2

(12) United States Patent
Kollé et al.

(10) Patent No.: US 7,524,160 B2
(45) Date of Patent: Apr. 28, 2009

(54) HYDROKINETIC SPEED GOVERNOR

(75) Inventors: Jack J. Kollé, Seattle, WA (US); Mark H. Marvin, Tacoma, WA (US)

(73) Assignee: Tempress Technologies, Inc., Kent, WA (US)

( * ) Notice: Subject to any disclaimer, the term of this patent is extended or adjusted under 35 U.S.C. 154(b) by 431 days.

(21) Appl. No.: 11/351,351

(22) Filed: Feb. 9, 2006

(65) Prior Publication Data

US 2006/0177308 A1 Aug. 10, 2006

Related U.S. Application Data

(60) Provisional application No. 60/652,406, filed on Feb. 10, 2005.

(51) Int. Cl.
*F04D 29/44* (2006.01)

(52) U.S. Cl. ..... 415/1; 415/199.2

(58) Field of Classification Search ..... 415/123, 415/199.2

See application file for complete search history.

(56) References Cited

U.S. PATENT DOCUMENTS

| | | | | |
|---|---|---|---|---|
| 3,728,040 A | | 4/1973 | Ioanesian et al. | 415/123 |
| 4,213,332 A | | 7/1980 | Bonomo et al. | 73/862.14 |
| 4,454,935 A | * | 6/1984 | Pryor | 415/58.1 |
| 4,979,577 A | | 12/1990 | Walter | 175/56 |
| 4,997,159 A | | 3/1991 | Yoshino et al. | 251/29 |
| 5,279,262 A | | 1/1994 | Muehleck | 122/26 |
| 5,703,421 A | | 12/1997 | Durkin | 310/61 |
| 5,740,127 A | | 4/1998 | Van Steenwyk et al. | 367/85 |
| 6,191,511 B1 | | 2/2001 | Zysset | 310/60 A |
| 6,237,701 B1 | | 5/2001 | Kollé et al. | 175/1 |
| 2001/0030486 A1 | | 10/2001 | Pijanowski | 310/254 |
| 2002/0074891 A1 | | 6/2002 | Gieras et al. | 310/254 |
| 2002/0149274 A1 | | 10/2002 | Pullen et al. | 310/58 |
| 2003/0151975 A1 | | 8/2003 | Zhou et al. | 367/31 |

* cited by examiner

*Primary Examiner*—Richard Edgar
(74) *Attorney, Agent, or Firm*—Ronald M. Anderson

(57) ABSTRACT

A method for governing the speed of a fluid turbine by establishing a circulating flow and a rotational flow with a rotor, and interrupting the rotational flow with an opposing stator. A related braking apparatus includes a housing, a rotatable shaft, a rotor configured to rotatingly engage the shaft and engage a fluid in the housing with a plurality of radial vanes, and a non-rotating stator comprising a plurality of fluid pockets. The stator is disposed such that the radial vanes of the rotor and the fluid pockets of the stator are oriented in a facing relationship. When the shaft is rotated, the fluid in the housing experiences both a circulating flow and a rotational flow. Thus, the rotational flow is present proximate the radial vanes, but not in the fluid pockets, and the fluid imparts a braking torque on the rotating shaft via the rotor's radial vanes.

23 Claims, 3 Drawing Sheets

HYDROKINETIC SPEED GOVERNOR

RELATED APPLICATIONS

This application is based on a prior copending provisional application Ser. No. 60/652,406, filed on Feb. 10, 2005, the benefit of the filing date of which is hereby claimed under 35 U.S.C. § 119(e).

BACKGROUND

Reaction-turbine jet rotors use the torque from the thrust of offset jets to drive the rotation of a jetting head. Fluids pumped through these tools may include water, a water and nitrogen mixture, carbon dioxide, concentrated acid, and solvents. Reaction-turbines generate relatively low torque, so the bearings and seals must exhibit a low static friction to ensure reliable startup. The dynamic seal friction is always less than the startup friction. The torque required to reliably start the rotor is therefore typically substantially higher than the seal and bearing frictional torque. Therefore, once the startup friction is overcome, the rotors will speed up to near the runaway speed, which is determined by the tangential velocity component of the jet. The runaway speed is typically relatively high, and unfortunately, the jet effectiveness at these relatively high speeds is relatively low. High rotary speed also causes premature wear of rotor seals and bearings. Similar problems are encountered with turbine motors used for drilling. High torque turbine motors provide good drilling performance, but tend to over-speed when the bit is off bottom and not generating drag.

A variety of braking mechanisms have been developed to govern the rotary speed of a jet rotor using a reaction turbine drive. These braking mechanisms include friction speed governors, magnetic eddy current speed governors, and viscous speed governors. Each of these speed governor mechanisms have limitations at high temperature, in high-pressure multiphase flows, and in corrosive fluid environments (particularly concentrated acid environments). Axial flow turbine speed governors (such as those described in U.S. Pat. No. 3,278,040) employ vertical axial flow stators and rotors with a torque curve that increases from zero at stall, to a level that balances the torque generated by the drive section of the turbine. The brake/speed governor torque increases linearly with speed.

It would be desirable to provide a hydrokinetic speed governor of simple and compact design, which exhibits a torque curve that increases as the square of rotary speed, to provide improved speed control. It would further be desirable to provide such a hydrokinetic speed governor mechanism that can be readily constructed from a variety of corrosion-resistant materials, to provide a general speed governing mechanism for use in reaction turbine rotors employed in rotary jetting tools and in axial flow turbine motors used for drilling. Preferably, such a hydrokinetic speed governor mechanism should be configured for use with any almost fluid, including liquids, gases, or mixtures of liquids and gases.

SUMMARY

A novel concept disclosed herein is directed to a method for governing the speed of a fluid driven unit. The method includes the steps of rotating a volume of fluid to impart both a circulating flow and a rotational flow to the fluid, and then interrupting the rotational flow to generate a braking torque, thereby governing the speed of the fluid driven unit. In a particularly preferred embodiment, the step of interrupting the rotational flow to generate a braking torque includes the step of generating a braking torque that is substantially proportional to a square of a speed of the rotational flow.

Such a method can be implemented by introducing a rotor comprising a plurality of vanes defining a plurality of rotor fluid pockets into the volume of fluid. The rotor is rotatingly coupled to a shaft that is drivingly coupled to the fluid driven unit. The fluid driven unit is energized, thereby rotating the rotor, such that the plurality of vanes impart a rotational force upon the fluid disposed in the rotor fluid pockets.

The step of interrupting the rotational flow to generate a braking torque can be implemented by interrupting the rotational flow using a stator comprising a plurality of stator fluid pockets disposed in a facing relationship relative to the plurality of rotor fluid pockets.

The magnitude of the braking torque can be manipulated by controlling the number of pairs of rotor fluid pockets and stator fluid pockets that are disposed in the facing relationship. Increasing the number of rotors and stators will generally increase the braking torque, whereas decreasing the number of rotors and stators will generally decrease the braking torque. In a particularly preferred embodiment, the stators and rotors are double-sided, to increase the number of pairs of rotor fluid pockets and stator fluid pockets that are disposed in the facing relationship, compared to the number of pairs of rotor fluid pockets and stator fluid pockets oriented in the facing relationship that could be achieved if the rotors and stators were only single-sided.

Preferably, the step of interrupting the rotational flow to generate a braking torque comprises the step of interrupting the rotational flow without completely interrupting the circulating flow of fluid.

Another aspect of the novel concept disclosed herein is directed to a speed governor apparatus for use with a fluid driven unit, comprising a housing defining a volume configured to be filled with a fluid, a shaft disposed in the housing (the shaft being configured to rotate relative to the housing), and a rotor configured to engage the shaft. Rotation of the shaft imparts a corresponding rotation to the rotor. The rotor includes a plurality of radial vanes configured to engage the fluid in the housing. Also included is a stator that is coupled to the housing such that the stator does not rotate. The stator also includes a plurality of fluid pockets and is disposed such that the radial vanes of the rotor and the fluid pockets of the stator are oriented in a facing relationship. Thus, when the shaft is rotated, the fluid in the housing experiences both a circulating flow and a rotational flow. The rotational flow is present proximate the radial vanes, but not the fluid pockets, and the fluid imparts a braking torque on the rotating shaft via the rotor's radial vanes.

Preferably, the stator comprises a circulation port configured to enable the fluid in the volume to be exchanged, to dissipate heat generated by the braking torque. It is also preferred to fabricate the stator and rotor from corrosion, erosion, abrasion, and heat resistant materials, depending upon the type of fluid to which the components will be exposed. Exemplary corrosion and heat resistant materials include polyether-ketone (PEK), polyether-ether-ketone (PEEK), polyether-ketone-ketone (PEKK), derivatives thereof, and nickel alloys. Exemplary erosion/abrasion resistant materials include steel alloys, nickel alloys, copper alloys, cemented carbides, and ceramics. The housing encompassing the stator and rotor will generally be implemented as a metallic pressure vessel.

Significantly, the braking torque of such a rotary speed governor apparatus is proportional to a square of a rotational speed of the rotor.

Preferably, the stator and rotor are double-sided, each side of the rotor including a plurality of radial vanes, and each side of the stator including a plurality of fluid pockets. In this manner, a plurality of rotors and stators can readily be disposed in the fluid-filled housing, to increase a magnitude of the braking torque imparted on the shaft.

In a particularly preferred embodiment, the shaft is hollow, such that a fluid can be conveyed through the shaft. A distal end of the shaft is configured to be coupled to a fluid driven unit. In embodiments where the hollow shaft comprises an inlet proximate a proximal end of the shaft, the inlet coupling the volume is defined by the housing in fluid communication with an interior volume of the hollow shaft, such that the fluid conveyed by the hollow shaft is directed into the volume defined by the housing. An outlet proximate a distal end of the shaft couples the volume defined by the housing in fluid communication with an interior volume of the hollow shaft, such that the fluid in the volume defined by the housing can be discharged from the volume. Fluid disposed in the volume can be circulated to dissipate heat generated by the braking torque. Incorporating a flow restriction configured to generate a pressure differential between the inlet and the outlet facilitates circulation of the fluid in the volume defined by the housing.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 1:
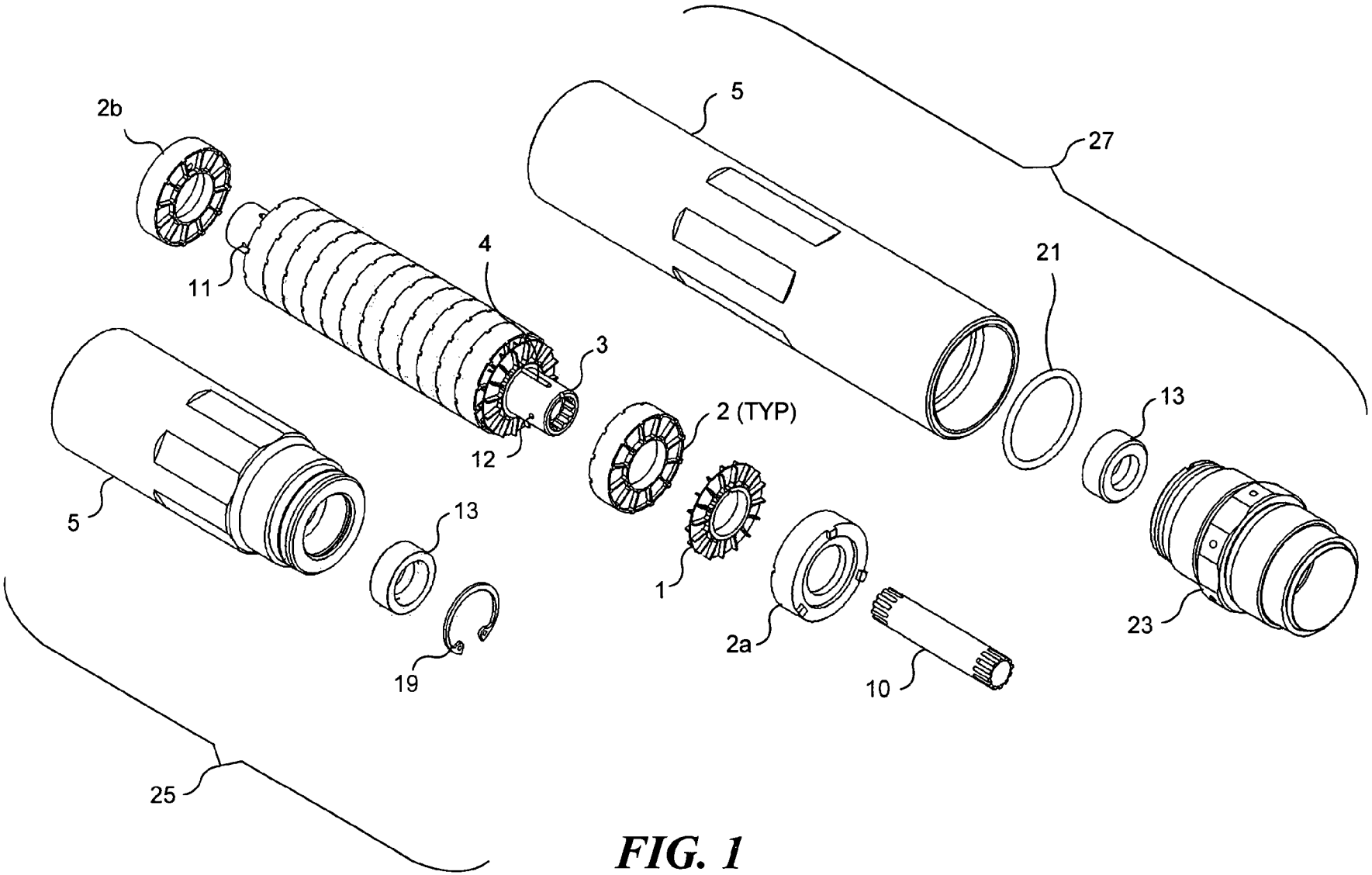
FIG. 1 is a schematic partially exploded view of an exemplary hydrokinetic speed governor stack and its housing in accord with the novel approach described herein.
Figure 4:
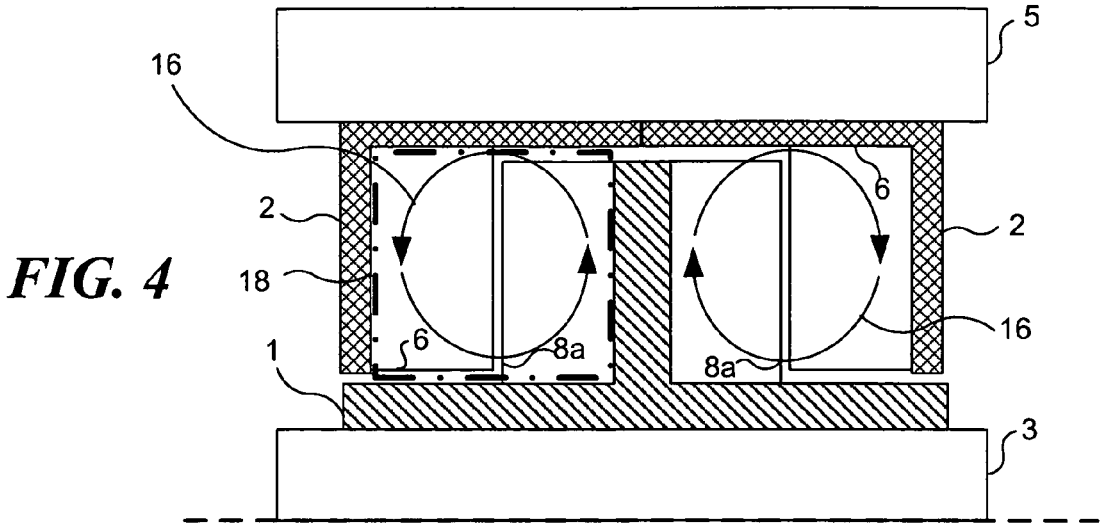
Figure 5:
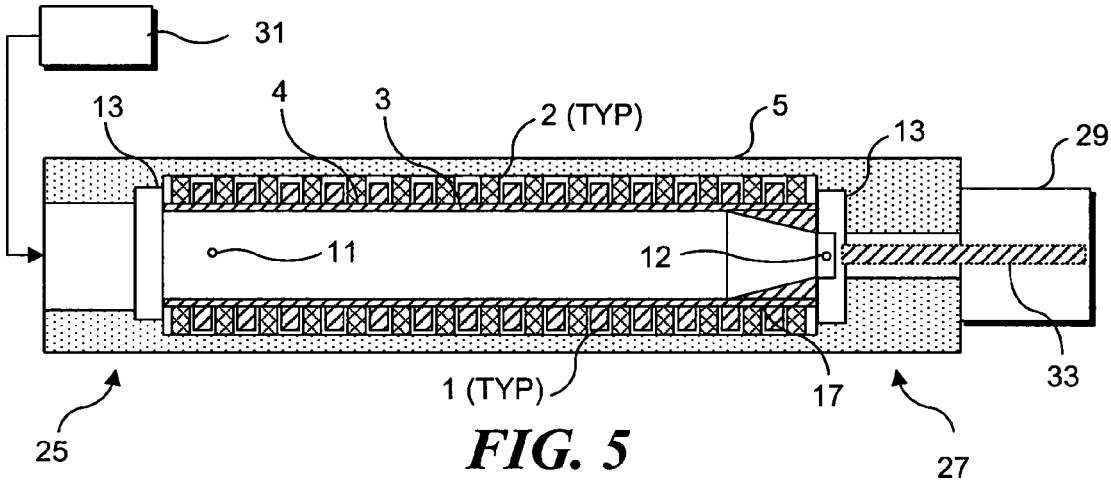
Figure 6:
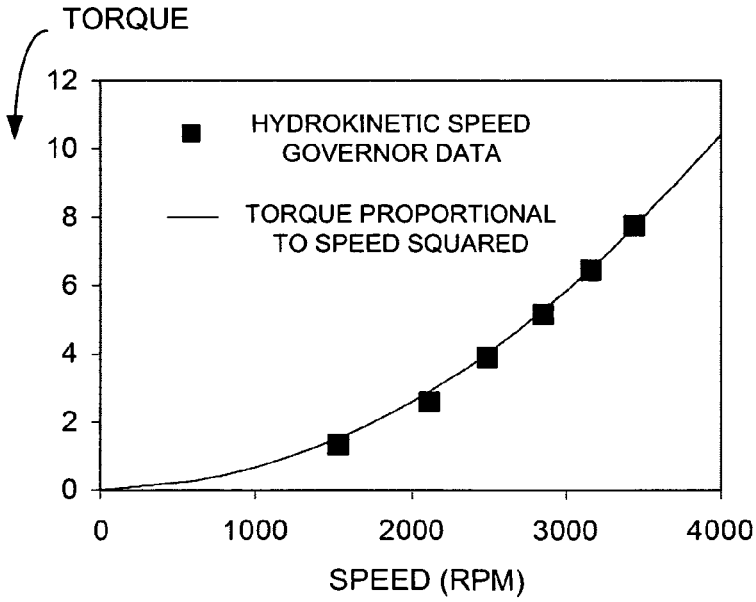

FIG. 4 schematically illustrates a fluid circulation pattern in a hydrokinetic speed governor pair included in the exemplary hydrokinetic speed governor stack of FIG. 1;

FIG. 5 schematically illustrates a flow restriction defined in a distal end of an exemplary preferred hollow speed governor shaft; and FIG. 6 graphically illustrates a torque versus speed relationship for the hydrokinetic speed governor of FIG. 1, indicating that the torque curve is proportional to the rotational speed squared.

DESCRIPTION

Figures and Disclosed Embodiments are Not Limiting

Exemplary embodiments are illustrated in referenced Figures of the drawings. It is intended that the embodiments and Figures disclosed herein are to be considered illustrative rather than restrictive.

FIG. 1 shows an exploded view of an exemplary hydrokinetic speed governor (or braking assembly) including a stack of rotors 1 and stators 2. Rotors 1 are rotatably coupled to a speed governor shaft 3, while stators 2 are secured to a housing 5 (defining a volume in which the rotors and stators are disposed), so that that the stators are fixed in position. Rotors 1 and stators 2 are stacked sequentially to achieve a speed governor stack. In an exemplary preferred configuration of the invention, rotors 1 each includes a slot 9 (see FIG. 3), so that the rotors are keyed to shaft 3 by a pin 4, but are free to move axially. Speed governor shaft 3 is free to rotate relative to housing 5. A distal end of shaft 3 can be drivingly coupled to a drive shaft (not separately shown) via a coupling 10.

Figure 2:
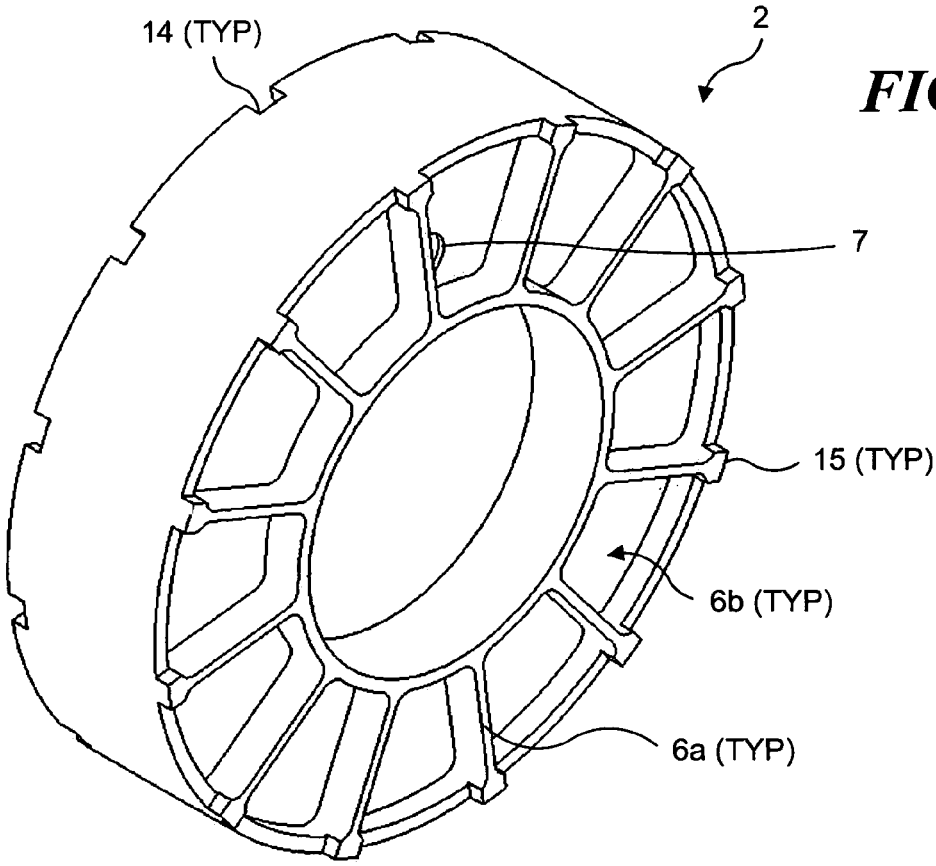
FIG. 2 shows a stator portion of a hydrokinetic speed governor pair included in the exemplary hydrokinetic speed governor stack of FIG. 1.
Figure 3:
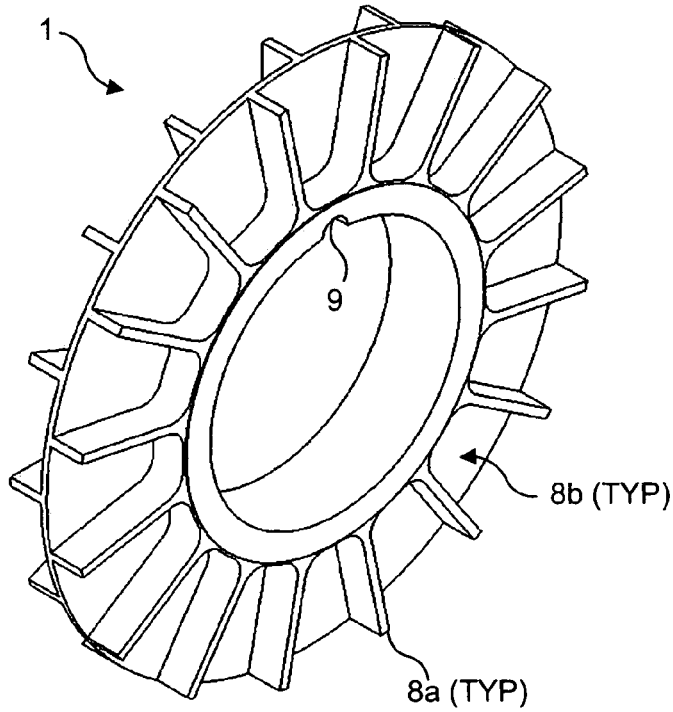
FIG. 3 shows a rotor portion of a hydrokinetic speed governor pair included in the exemplary hydrokinetic speed governor stack of FIG. 1.

As illustrated in FIG. 2, each stator 2 includes multiple vanes 6*a* that define a plurality of pockets 6*b* in the stator, and a bleed hole 7, which allows fluid to enter the stator. Each rotor 1, as illustrated in FIG. 3, incorporates a plurality of radial vanes 8*a*, disposed on both sides of the rotor that define a plurality of pockets 8*b* in the rotor. It should be recognized that single-sided rotors and stators can be employed (i.e., rotors and stators with vanes/pockets on only one face); however, utilizing double-sided stators and rotors will enable a greater braking torque to be achieved than would be achieved using the same number of rotors and stators that are single-sided. Thus, in a particularly preferred exemplary embodiment, rotors 1 and stators 2 are each are double-sided, with each rotor 1 being sandwiched between two double-sided stators 2. Notches 14 and bosses 15 on each stator 2 engage with other notches and bosses on adjacent stators, so that the stator stack does not rotate. The notches of the stator at a first end (i.e., a proximal end) of the stack engage housing 5, while the bosses of the stator at a second end (i.e., a distal end) of the stack also engage housing 5. If desired, a distal-most stator 2*a* can be implemented as single-sided stator (i.e., with pockets disposed on only a proximal side), since no rotor will be disposed distally of stator 2*a*. The same concept applies to the most proximally disposed stator 2*b*. Generally, however, it may be preferable to employ double-sided stators in all locations, to reduce the number of different types of components required.

Speed governor shaft 3 is supported by bushings 13 at a proximal end 25 and at a distal end 27. A clip 19 can be used to keep bushing 13 in place at proximal end 25, while a threaded coupling 23 secures bushing 13 (and a seal 21) in place at distal end 27. Preferably, coupling 23 is configured to enable the speed governor assembly to be coupled to a fluid driven apparatus, such as a fluid driven motor or a rotating jetting tool. In a particularly preferred embodiment, speed governor shaft 3 is hollow to allow fluid circulation, which enables fluid to be provided to a fluid driven apparatus disposed distally of the speed governor stack. In an alternative embodiment (less preferred), the speed governor stack includes a solid speed governor shaft, such that fluid provided to a fluid driven apparatus disposed distally of the speed governor stack must pass through the speed governor stack. In effect, the speed governor stack functions as a flow restrictor for this alternative embodiment.

In the particularly preferred embodiment, incorporating a hollow speed governor shaft, a flow restriction 17 (see FIG. 5) is provided at the distal end of the speed governor shaft, to generate a pressure differential between an inlet port 11 at the proximal end of the speed governor shaft and an outlet port 12 at the distal end of the speed governor shaft. It should be recognized that a plurality of inlet ports and outlet ports can be implemented. These two types of ports allow fluid to circulate through bleed ports 7 in the stators, to provide cooling that dissipates the heat generated by braking. An amount of fluid circulating through the speed governor stack via bleed holes 7, as compared to an amount of fluid conveyed through the hollow speed governor shaft, is not critical. Diverting as little as 1/10 of 1% of the volume of fluid conveyed through the hollow speed governor shaft through the speed governor stack via bleed ports 7 will likely provide a cooling effect. Those of ordinary skill in the art will recognize that if additional cooling is required, the relative sizes of flow restriction 17, inlet port 11, outlet port 12, and bleed ports 7 can be manipulated to increase the amount of fluid flow diverted from the hollow speed governor shaft into the speed governor stack. An exemplary, but not limiting, range for the volume of fluid flow diverted into the speed governor stack for cooling is from about 1% to about 10% of the fluid flow passing through hollow speed governor shaft 3. Note FIG. 5 illustrates a hydrokinetic speed governor including a plurality of alternating stators and rotors (i.e., a hydrokinetic speed governor consistent with FIG. 1) whose proximal end 25 is coupled in fluid communication with a fluid source 31 (such as a pump, or the distal end of a drill string coupled to a surface pump), and whose distal end 27 is coupled in fluid communication with a fluid driven device 29. It should be understood that speed governor shaft 3 is rotatably coupled with a shaft 33 in the fluid driven device, such that braking torque generated in the speed governor is transmitted from the speed governor shaft to the shaft in the fluid driven device, thereby governing a rotational speed of the fluid driven device.

In particularly preferred embodiments, the fluid driven device is either an axial flow turbine, or a reaction turbine jet rotor.

For applications (such as reaction turbine jet rotor applications) in which the rotors and stators are likely to be exposed to corrosive fluids, solvents, or water, the stators and rotors are preferably constructed from polyether-ether-ketone (PEEK), which provides a durable, temperature and corrosion resistant material that is compatible with a broad range of fluids, and which is a material from which the rotors and stators described above may be readily fabricated. Additional exemplary corrosion and heat resistant materials (which may be beneficially employed for applications such as speed governors configured for use with reaction turbine jet rotors) include polyether-ketone (PEK), polyether-ketone-ketone (PEKK), derivatives of PEK, PEEK, and PEKK, and nickel alloys. For applications (such as axial flow turbine drilling motors that are powered by erosive drilling mud) in which the rotors and stators are to be exposed to erosive or abrasive fluids, steel, cemented carbide, and ceramic stators and rotors may be beneficially employed. The housing encompassing the stator and rotor will generally be implemented as a steel based pressure vessel.

As indicated in FIG. 5, proximal end 25 of the braking apparatus (and speed governor shaft 3) is configured to be placed in fluid communication with a source of fluid (such as a pump or a drill string conveying a fluid to a downhole motor or some other fluid driven device), while distal end 27 is configured to be placed in fluid communication with a fluid driven unit. The term fluid driven unit is intended to encompass turbines, rotary turbines, turbine drills, and rotary jetting tools, and related mechanisms. The braking apparatus/speed governor disclosed herein will be particularly useful when employed to govern the speed of axial flow turbines and reaction turbine rotors. It should be recognized that the various elements of FIG. 5 are not drawn to scale.

Referring to FIG. 4, the fluid in the pockets of the rotor moves at the rotor speed, while the fluid in the pockets of the stator has no rotational speed. The fluid in the rotor pocket is centrifugally accelerated outwards in the rotor pocket. Flow is thus entrained at the inner radius of the rotor pocket and is discharged into the stator at the outer radius of the rotor pocket due to centrifugal force, generating a toroidal circulating flow 16. The circulating flow velocity and mass flow rate are proportional to the rotational speed of the rotor. The flow in the pockets defined by the rotor vanes has a rotational component about the axis of rotation of the rotor, in addition to the toroidal circulating flow component. Flow in the pockets defined in the stator has no rotational component because of the fixed vanes (i.e., because the stator and its vanes are fixed in position relative to the vanes of the rotating rotor). The circulating fluid is thus subject to rotational acceleration as it reenters the rotor. One of ordinary skill in the art of fluid dynamics will recognize that the reaction torque on the rotor is the product of the toroidal circulation mass flow rate times the rotational speed of the rotor. Since the toroidal circulation mass flow rate is also proportional to rotational speed, the net torque is proportional to the square of the rotational speed of the rotor. As indicated in FIG. 4, a cross-section 18 of the volume formed by opposed rotor pockets **8*b* and stator pockets 6*b***, in which the toroidal circulating flow develops, is generally square. Those skilled in the art will recognize that alternative cross section geometries with rounded corners, circular or elliptical sections, or other different aspect ratios may be employed to improve performance or to accommodate other design constraints.

FIG. 6 shows actual torque versus speed measurements collected from an empirical hydrokinetic speed governor assembly based on FIG. 1. The empirical results show that the torque increases proportionally to the square of the rotational speed. Because of this aspect of the speed governor, the rotor will spin at a highly predictable constant speed when subject to a fixed drive torque, such as that produced by a reaction turbine rotor or axial flow turbine. In practice, a single rotor/stator pair may not provide sufficient braking torque. If so, multiple rotors and stators are readily stacked to provide the required drag for braking. The number of rotor/stator pairs may be increased or decreased to provide the desired rotational speed.

Although the present novel concept has been described in connection with the preferred form of practicing it and modifications thereto, those of ordinary skill in the art will understand that many other modifications can be made to the present novel concept within the scope of the claims that follow. Accordingly, it is not intended that the scope of the novel concept disclosed herein in any way be limited by the above description, but instead be determined entirely by reference to the claims that follow.

The invention in which an exclusive right is claimed is defined by the following:

1. A rotary speed governor apparatus for use with a fluid driven unit, the rotary speed governor apparatus being configured to be employed redundantly if desired, the rotary speed governor apparatus comprising:

(a) a rotor configured to be disposed in a fluid-filled housing and to engage a shaft, such that the rotor and shaft can rotate about a common axis relative to the housing, the rotor including a plurality of radial vanes configured to engage the fluid in the fluid-filled housing; and (b) a stator comprising:

(i) a plurality of fluid pockets, such that the rotor, the stator, and the fluid in the housing interact to generate a braking torque that is imparted to the rotor and the shaft; and (ii) means for securing a plurality of stators together to form a stack in which the plurality of stators remain fixed in position relative to one another, thus enabling a plurality of rotors and the plurality of stators to be disposed in an alternating configuration to achieve a speed governor stack, to increase the braking torque imparted to the shaft compared to that provided by only a single stator and a single rotor, thus enabling the rotary speed governor apparatus to be employed redundantly.

2. The rotary speed governor apparatus of claim 1, wherein the stator is configured to be secured to the housing, such that the stator does not move relative to the rotor or the housing.

3. The rotary speed governor apparatus of claim 1 further comprising a coupling attached to a distal end of the rotary speed governor apparatus, the coupling enabling the rotary speed governor apparatus to be coupled to a fluid driven unit, such that when the rotary speed governor apparatus is coupled to the fluid driven unit, fluid exits the distal end of the rotary speed governor apparatus and enters the fluid driven unit, causing a shaft in the fluid driven unit to rotate, rotation of the shaft in the fluid driven unit causing the shaft in the rotary speed governor apparatus to rotate at a speed governed by rotary speed governor apparatus.

4. The rotary speed governor apparatus of claim 1, wherein the stator and rotor comprise at least one of polyether-ketone (PEK), polyether-ether-ketone (PEEK), polyether-ketone-ketone (PEKK), derivatives thereof, and a nickel alloy.

5. The rotary speed governor apparatus of claim 1, wherein the stator and rotor are fabricated from an abrasion resistant material, wherein the abrasion resistant material comprises at least one element selected from the group consisting essentially of a cemented carbide, and a ceramic.

6. The rotary speed governor apparatus of claim 1, wherein said means for securing the plurality of stators together to form a stack comprises at least one boss formed into a first face of the stator and at least one notch formed into a second face of the stator, such that when a plurality of rotors and stators are assembled to achieve the speed governor stack, the notches and bosses of each pair of stators having a rotor disposed between them engage.

7. The rotary speed governor apparatus of claim 1, wherein the rotor is configured to be coupled to the shaft to be rotated with the shaft, while enabling the rotor to move axially relative to the shaft.

8. A rotary speed governor apparatus for use with a fluid driven unit, comprising:

(a) an elongate housing having an internal bore defining a volume configured to be filled with a fluid;

(b) a shaft disposed in the housing, the shaft being configured to rotate about a longitudinal axis of the housing;

(c) a plurality of rotors disposed about the longitudinal axis and configured to engage the shaft, such that rotation of the shaft imparts a corresponding rotation to each rotor, each rotor including a plurality of radial vanes configured to engage the fluid in the housing; and (d) a plurality of stators coupled to the housing about the longitudinal axis such that each stator does not rotate relative to the housing or relative to each rotor, the plurality of rotors and the plurality of stators being stacked in an alternating relationship, each stator comprising a plurality of fluid pockets, the plurality of stators, the plurality of rotors, and a fluid in the housing interacting to generate a braking torque on the rotating shaft.

9. The rotary speed governor apparatus of claim 8, wherein each stator comprises means for securing the plurality of stators together to form a stack, such that the plurality of stators remain fixed in position relative to one another, thus enabling a number of stators and rotors employed to be selectively varied, so that the braking torque imparted to the shaft is increased when more stators and rotors are employed, and is decreased when fewer stators and rotors are employed.

10. The rotary speed governor apparatus of claim 8, wherein each stator and each rotor comprise at least one of polyether-ketone (PEK), polyether-ether-ketone (PEEK), polyether-ketone-ketone (PEKK), and derivatives thereof.

11. The rotary speed governor apparatus of claim 8, wherein each stator and each rotor are double-sided, each side of the rotor including the plurality of radial vanes, and each side of the stator including the plurality of fluid pockets.

12. The rotary speed governor apparatus of claim 8, wherein a distal end of the shaft is configured to be coupled to a fluid driven unit.

13. The rotary speed governor apparatus of claim 8, wherein the shaft is hollow, such that a fluid can be conveyed through the shaft.

14. The rotary speed governor apparatus of claim 13, wherein the shaft comprises an inlet proximate a proximal end of the shaft, coupling the volume defined by the housing in fluid communication with an interior volume of the hollow shaft, such that the fluid conveyed by the hollow shaft is directed into the volume defined by the housing.

15. The rotary speed governor apparatus of claim 14, wherein the shaft comprises an outlet proximate a distal end of the shaft, coupling the volume defined by the housing in fluid communication with an interior volume of the hollow shaft, such that the fluid in the volume defined by the housing can be discharged from the volume, enabling fluid in the volume to be circulated to dissipate heat generated by the braking torque.

16. The rotary speed governor apparatus of claim 15, wherein the distal end of the shaft comprises a flow restriction configured to generate a pressure differential between the inlet and the outlet, to control circulation of the fluid in the volume defined by the housing.

17. A method for governing the speed of a fluid driven unit, comprising the steps of:

(a) providing a source of pressurized fluid, and a governing unit;

(b) directing the pressurized fluid first into the governing unit, and then into the fluid driven unit, the pressurized fluid directed into the fluid driven unit energizing the fluid driven unit, and rotating a volume of pressurized fluid in the governing unit, to impart both a circulating flow and a rotational flow to the volume of pressurized fluid in the governing unit; and (c) interrupting the rotational flow in the governing unit to generate a braking torque, thereby governing the speed of the fluid driven unit.

18. The method of claim 17, wherein the step of interrupting the rotational flow to generate a braking torque comprises the step of interrupting the rotational flow using a plurality of stators and rotors stacked in an alternating configuration, such that the magnitude of the braking torque is a function of a number of stators and rotors included in the stack.

19. The method of claim 18, further comprising the step of increasing a magnitude of the braking torque by introducing additional similarly oriented rotors and stators into the volume of fluid.

20. A method for governing the speed of a fluid driven unit, comprising the steps of:

(a) providing a source of pressurized fluid, and a governing unit, the governing unit comprising a rotor, a shaft and a stator, wherein the shaft is drivingly coupled to the fluid driven unit, the rotor is rotated with the shaft, and the stator is fixed relative to the shaft and the rotor;

(b) directing the pressurized fluid first into the governing unit, and then into the fluid driven unit, the pressurized fluid directed into the fluid driven unit energizing the fluid driven unit, thereby causing the shaft and rotor to rotate within the governing unit, the rotor imparting both a circulating flow and a rotational flow to the pressurized fluid in the governing unit; and (c) interrupting the rotational flow in the governing unit with the stator, to generate a braking torque imparted upon the rotor and shaft, thereby governing the speed of the fluid driven unit.

21. The method of claim 20, further comprising the step of increasing a magnitude of the braking torque by introducing additional rotors and stators into the volume of fluid, such that the rotors and stators are stacked in the governing unit in an alternating configuration.

22. The method of claim 20, wherein the fluid driven unit whose speed is being governed by the braking torque comprises at least one of an axial flow turbine and a reaction turbine rotor.

23. A method for governing the speed of a reaction turbine jet rotor, comprising the steps of:

(a) providing a source of pressurized fluid, a governing unit comprising a shaft, a rotor, and a stator, the governing unit and the reaction turbine jet rotor being configured such that energizing the reaction turbine jet rotor results in rotation of the shaft in the governing unit;

(b) directing a pressurized fluid into the governing unit, the pressurized fluid filling the braking unit and then flowing into the reaction turbine jet rotor, energizing the reaction turbine jet rotor, thereby causing the shaft and rotor in the governing unit to rotate within the pressurized fluid in the governing unit, the rotor imparting both a circulating flow and a rotational flow to the pressurized fluid in the governing unit; and (c) interrupting the rotational flow in the governing unit with the stator, to generate a braking torque imparted upon the rotor and shaft in the governing unit, thereby governing the speed of the reaction turbine jet rotor.

* * * * *